United States Patent [19]

Farago et al.

[11] Patent Number: 5,067,655

[45] Date of Patent: Nov. 26, 1991

[54] WHIRL NOZZLE FOR ATOMIZING A LIQUID

[75] Inventors: Zoltan Farago, Ravenstein-Merchingen; Tom Schork, Adelsheim, both of Fed. Rep. of Germany

[73] Assignee: Deutsche Forschungsanstalt fuer Luft- und Raumfahrt, Fed. Rep. of Germany

[21] Appl. No.: 393,907

[22] PCT Filed: Dec. 9, 1988

[86] PCT No.: PCT/EP88/01133

§ 371 Date: Sep. 20, 1989

§ 102(e) Date: Sep. 20, 1989

[87] PCT Pub. No.: WO89/05195

PCT Pub. Date: Jun. 15, 1989

[30] Foreign Application Priority Data

Dec. 11, 1987 [DE] Fed. Rep. of Germany ..... 3742015

[51] Int. Cl.[5] ..... B05B 1/34

[52] U.S. Cl. ..... 239/124; 239/463; 239/493; 239/497

[58] Field of Search ..... 239/124, 463, 491–497

[56] References Cited

U.S. PATENT DOCUMENTS

| | | | |
|---|---|---|---|
| 1,008,119 | 11/1911 | Dahl | 239/496 |
| 1,650,128 | 11/1927 | Hubbard | 239/494 X |
| 1,757,023 | 5/1930 | Smith | 239/497 X |
| 1,837,339 | 12/1931 | Schlick . | |
| 2,017,467 | 10/1935 | Loomis | 239/497 X |
| 2,065,161 | 12/1936 | Thompson . | |
| 2,176,356 | 10/1939 | Paasche | 239/494 X |
| 2,374,041 | 4/1945 | Saha | 239/124 X |

FOREIGN PATENT DOCUMENTS

| | | |
|---|---|---|
| 280632 | 11/1914 | Fed. Rep. of Germany . |
| 314080 | 8/1919 | Fed. Rep. of Germany . |
| 1750561 | 1/1971 | Fed. Rep. of Germany . |
| 2814246 | 10/1979 | Fed. Rep. of Germany . |
| 3703075 | 3/1989 | Fed. Rep. of Germany . |
| 1560603 | 3/1969 | France . |
| 357035 | 10/1961 | Switzerland . |
| 162172 | 4/1921 | United Kingdom . |

OTHER PUBLICATIONS

Research Report of VLR-F8 87-25 (ISSN 0171-1342), p.22 (German Language).

*Primary Examiner*—Andres Kashnikow
*Assistant Examiner*—William Grant
*Attorney, Agent, or Firm*—Barry R. Lipsitz

[57] ABSTRACT

A whirl nozzle for atomizing a liquid has a whirl chamber rising above a whirl chamber bottom and tapering toward a nozzle outlet orifice opposite the bottom, at least one whirl channel laterally offset to a central axis of the whirl chamber and opening into the latter, and a whirl parameter of greater than 1, so as to permit an increase in the whirl input pulse at constant or reduced whirl losses. A displacement element rises above the whirl chamber bottom to prevent the formation of an air core in the region of the floor. The element is arranged concentrically about the central axis and the external diameter of the section nearer the floor is equal to at least one diameter of the nozzle outlet orifice. In one embodiment, the conical seating surface has a smaller apex angle than a section of the whirl chamber wall adjoining the nozzle outlet orifice. In another embodiment, the displacement element is provided with at least one eccentrically arranged reflux bore.

15 Claims, 8 Drawing Sheets

WHIRL NOZZLE FOR ATOMIZING A LIQUID

Figure 1:
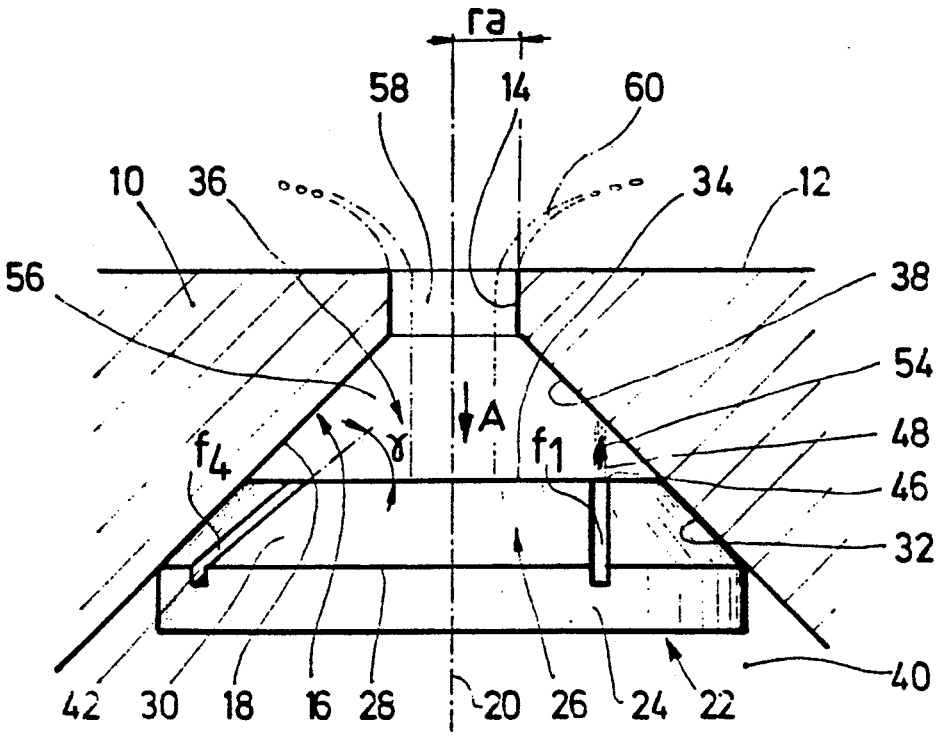
Fig. 1 (PRIOR ART)

The invention relates to a whirl nozzle for atomizing a liquid comprising a whirl chamber rising above a whirl chamber bottom and tapering towards a nozzle outlet orifice opposite the whirl chamber bottom, at least one whirl channel laterally offset in relation to a central axis of the whirl chamber and opening into the whirl chamber, and a whirl parameter of $>1$.

In such known whirl nozzles, the liquid to be atomized flows through the whirl channel preferably in a tangential direction into the whirl chamber in which it moves in the direction of the central axis of the whirl chamber, with its circumferential velocity increasing as it does so. With a whirl parameter of the whirl nozzle of $>1$, the liquid cannot flow as far as to the central axis on account of the centrifugal forces, and, therefore, an air core extending over the total height of the whirl chamber forms around the central axis. The liquid flows around this air core and hence passes through the nozzle outlet orifice as a rotating liquid film ring and subsequently forms a liquid film core which disintegrates into small liquid droplets as a result of its own instability.

In order to obtain liquid droplets which are as fine as possible, a large air core diameter is desired. This is attainable only with a correspondingly large whirl input pulse of the liquid jet. On the one hand, this could be increased by the tangential velocity of the liquid jet being increased. However, this tangential velocity is practically determined by a maximum pressure based on expediency and a minimum cross-section on account of the danger of clogging. On the other hand, the whirl input pulse could be increased by increasing the so-called whirl channel eccentricity, i.e., the distance of a central line of the whirl channel from the central axis. In the known whirl nozzles, however, this measure increases the whirl losses which are dependent on an air core diameter and an air core length and, therefore, in practice, no further improvements are possible in the known whirl nozzles with respect to the whirl channel eccentricity.

The object underlying the invention is, therefore, to improve a whirl nozzle of the generic kind such that an increase in the whirl input pulse is possible while the whirl losses remain the same or are reduced.

This object is accomplished, in accordance with the invention, in a whirl nozzle of the kind described at the beginning in that a displacement element rises above the whirl chamber bottom to prevent formation of an air core in a region of the whirl chamber near the bottom, the displacement element being arranged concentrically with the central axis and the section of the displacement element near the bottom having an external diameter corresponding to at least one diameter of the nozzle outlet orifice. The inventive provision of the displacement element has the advantage that in the region near the bottom, the whirl chamber has the shape of an annular space extending around the displacement element and so no air core resulting in the whirl nozzle losses described above can form in this region. Hence in the inventive whirl nozzle, the whirl channel eccentricity can be chosen larger without an overall increase in the whirl losses and so high atomizing efficiency of the inventive whirl nozzles is achievable. It is even possible to increase the whirl channel eccentricity to the extent that the tangential velocity of the liquid jet can be chosen lower and hence a cross-section of the whirl channels larger, which reduces the danger of the nozzle becoming clogged.

Within the scope of the inventive solution, it has proven particularly advantageous for the displacement element to extend with a mean diameter corresponding to at least the diameter of the nozzle outlet orifices over at least approximately half of the height of the whirl chamber in the direction towards the nozzle outlet orifice.

It is, however, even more expedient for the displacement element to extend with a mean diameter corresponding to at least the diameter of the nozzle outlet orifices over at least approximately two thirds of the height of the whirl chamber.

In order to achieve flow conditions which are as uniform as possible in the whirl chamber, it has proven extremely expedient for a surface of the displacement element facing an outer whirl chamber wall to be spaced in each cross-sectional plane with respect to the central axis, all the way around in the circumferential direction, at a constant distance from the whirl chamber wall.

In a development of the above-mentioned solution, it is expedient for the surfaces facing the whirl chamber wall in a section of the displacement element facing the nozzle outlet orifice to extend at a constant distance from the whirl chamber wall so that in this section the whirl chamber is an annular channel with a constant hydraulic diameter which ensures even distribution of the circulating liquid.

As far as the dimensions of the distance are concerned, it has proven particularly advantageous for the distance to correspond approximately to one width of the whirl channel.

Regarding the shape of the whirl chamber, it has proven expedient for the latter to be axially symmetrical with the central axis, which necessarily results in the displacement element also being of axially symmetrical configuration.

In the embodiment described so far, it has not been explained more fully how the whirl channels lead into the whirl chamber. They may lead in in any chosen manner. In connection with manufacture of an inventive whirl nozzle, however, it has proven advantageous for ports of the whirl channels to lie in an annular region of the whirl chamber bottom extending around the displacement element.

As explained at the outset, it is desired that the eccentricity of the whirl channels leading into the whirl chamber be as large as possible and, therefore, in a preferred embodiment, provision is made for the width of the annular region to correspond to the extent of the port from an outer rim of this region in the radial inward direction, i.e., the width of this annular region is chosen no greater than is required to accommodate the port of the whirl channel.

As described at the beginning, the whirl channel will expediently extend in the port region thereof with its central line substantially tangential to the whirl chamber wall. A particularly large whirl channel eccentricity is, however, achievable by the whirl channel leading with a port in the form of an annular segment along an outer rim region of the whirl chamber bottom into the whirl chamber because, in this case, the radial extent of the port in the direction towards the central axis corresponds to only one width of the whirl channel, and hence the liquid jet on entering the whirl chamber will flow along the whirl chamber wall and, with a given whirl chamber diameter, will flow into the whirl chamber at the largest possible distance from the central axis.

Particularly in order that manufacture of the inventive whirl nozzle will be as simple as possible, it is expedient for the whirl channel to extend in straight configuration from a pressure chamber to the whirl chamber. It is, however, even more advantageous for the whirl channel to extend in helical configuration with respect to the central axis from a pressure chamber to the whirl chamber since, in this case, the whirl chamber can be provided with a lower gradient with respect to the central axis and hence proceeding from a constant flow velocity of the liquid in this whirl channel, the liquid jet emerging from it has as large a tangential velocity component as possible in a plane perpendicular to the central axis and as small a velocity component as possible parallel to the central axis.

In all cases, the whirl channels will preferably have a substantially constant cross-section.

Manufacture of the inventive whirl nozzle is particularly simple if it has an external component comprising the nozzle outlet orifice and an adjoining recess extending along the central axis and exhibiting a larger cross-sectional area as it progresses further, and if an internal component with a whirl chamber bottom extending perpendicular to the central axis is inserted in a positively connected manner in this recess so that the whirl chamber bottom and wall surfaces of the recess located between the whirl chamber bottom and the nozzle outlet orifice delimit the whirl chamber.

The inventive whirl nozzle is particularly easy to manufacture if the wall surface of the recess forms the lateral area of a conical frustum which is coaxial with the central axis as such a conical surface is easy to manufacture by conventional methods.

Since the whirl chamber wall should be the lateral area of a cone with as large an apex angle as possible in order to keep the height of the whirl chamber and hence the length of the air core as small as possible, but such a large apex angle provides a bad positively connected seating for the internal component, provision is made in a particularly preferred embodiment for the wall surfaces of the recess to form a conical seating surface for the frustoconical internal component and for the conical seating surface to have a smaller apex angle than a section of the whirl chamber wall adjoining the nozzle outlet orifice.

In particular, in connection with the last mentioned embodiment of the inventive whirl nozzle, it has proven expedient for the displacement element to be a cone with an apex angle corresponding to the section adjoining the nozzle outlet orifice.

In all of the embodiments of the inventive whirl nozzle described so far, it has been assumed that a whirl nozzle is used without a reflux bore. It does, however, also lie within the scope of the present invention for the displacement element to be provided with a central reflux bore.

As an alternative to the arrangement of the reflux bore centrally in relation to the displacement element, the present inventive solution offers the possibility of arranging the reflux bore eccentrically in relation to the displacement element. In this case, it is particularly advantageous for the reflux bore to be arranged at a distance from the central axis of the displacement element which corresponds to at least one radius of the nozzle outlet orifice so that if a residual air core should form in the region of the outlet orifice, it does not stand above the reflux bore and thereby influence it.

Finally, it is expedient for the reflux bores to be arranged at a distance from the central axis which is smaller than the distance of the whirl channel port therefrom.

Figure 2:
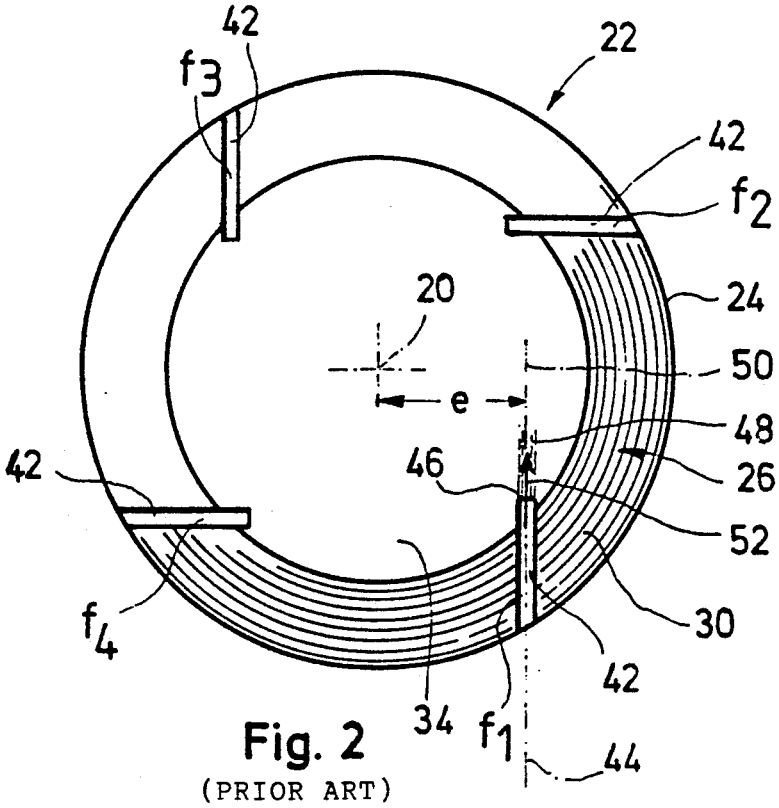
Fig. 2 (PRIOR ART)
Figure 3:
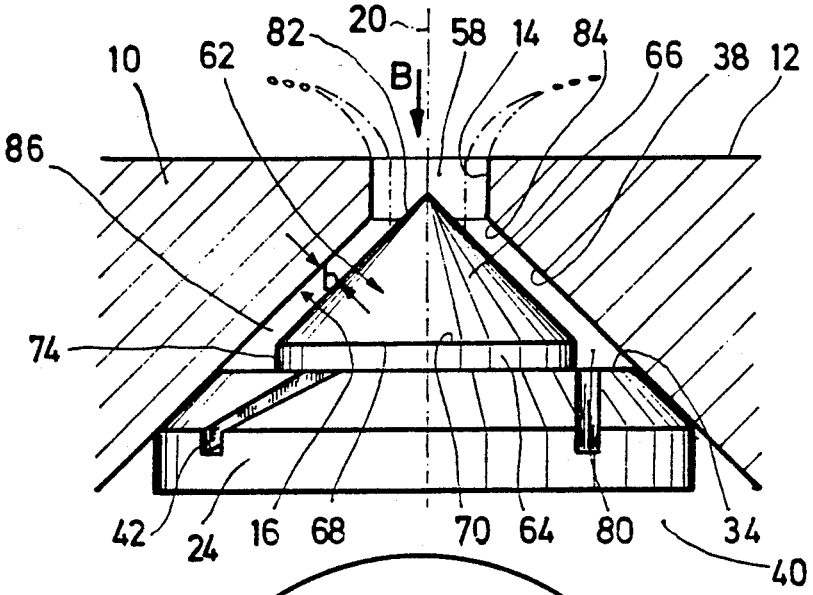
Figure 4:
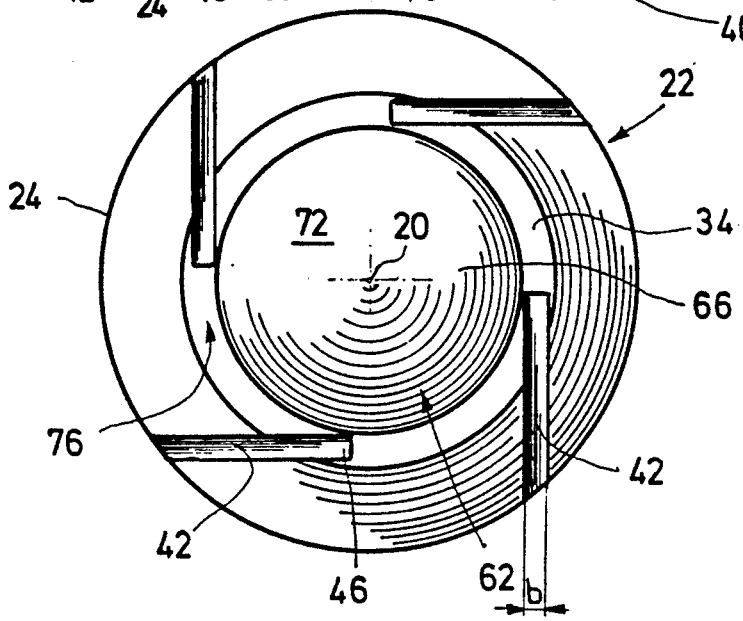
Figure 5:
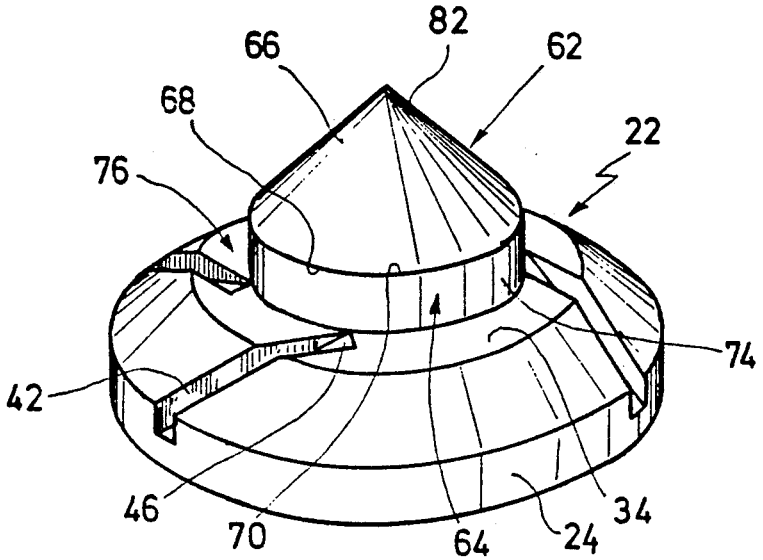
Figure 6:
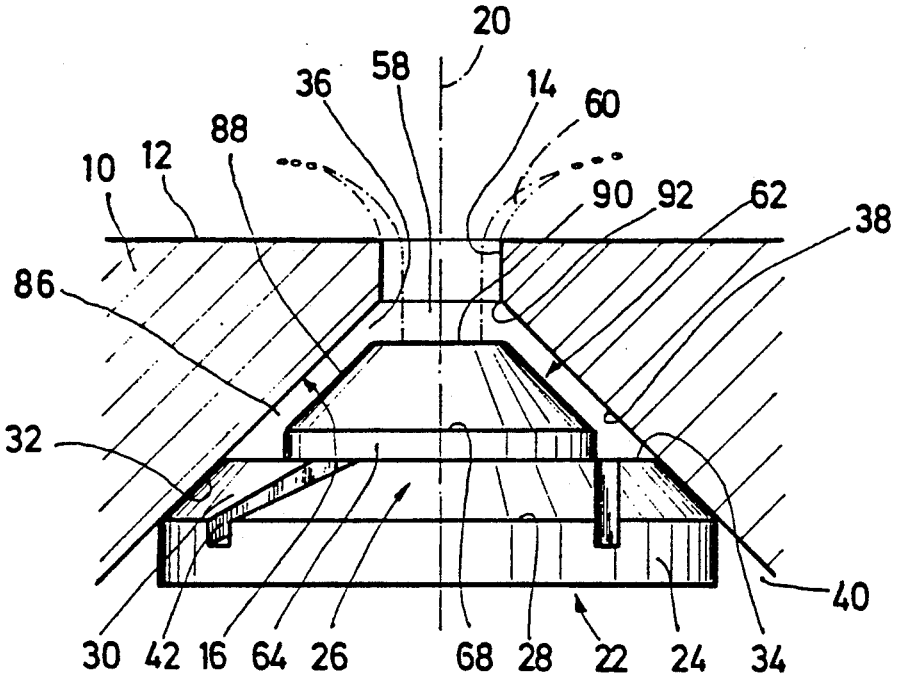
Figure 7:
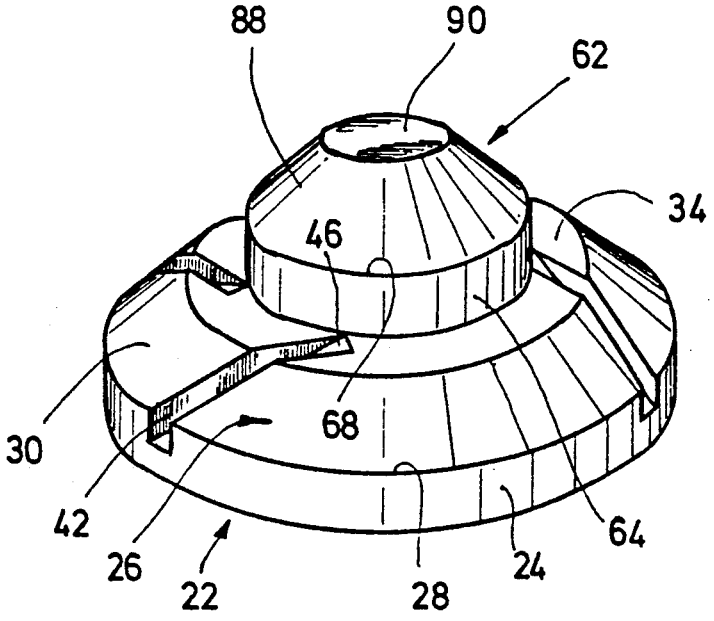
Figure 8:
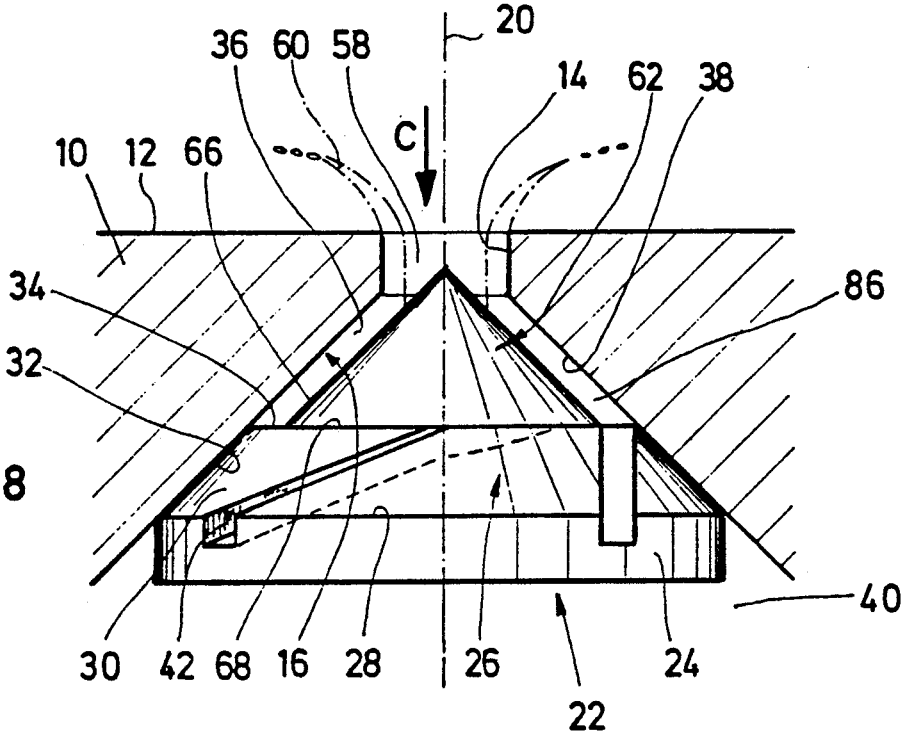
Figure 9:
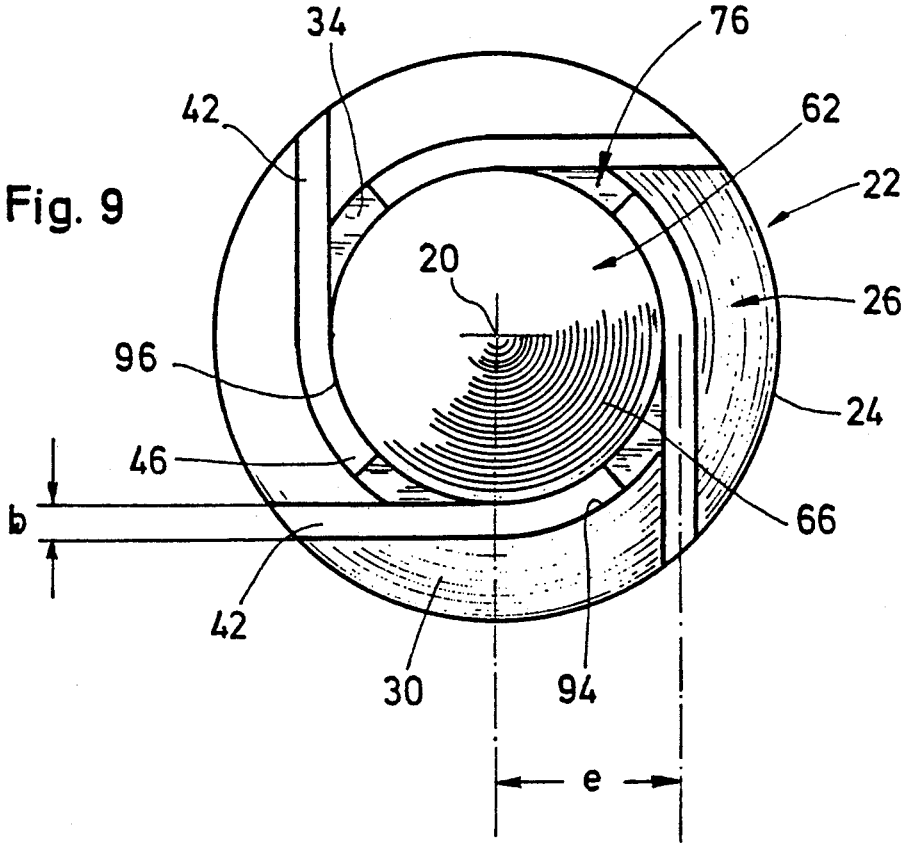
Figure 10:
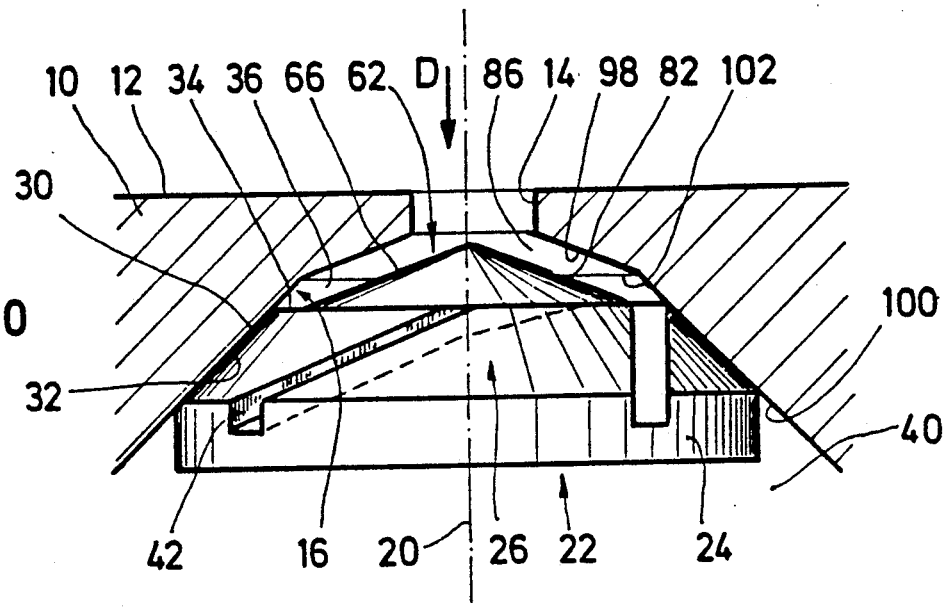
Figure 11:
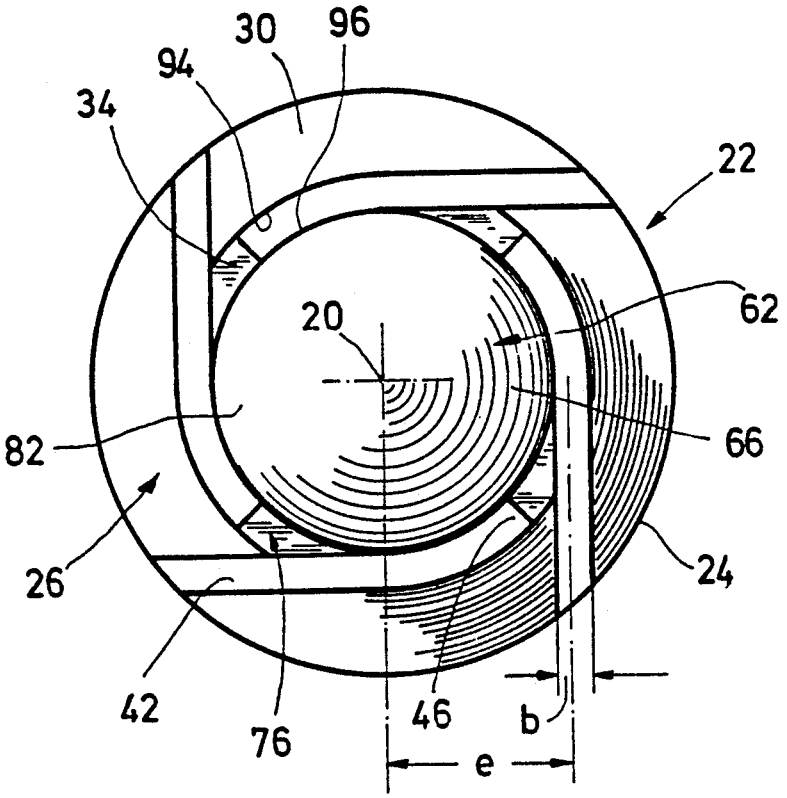
Figure 12:
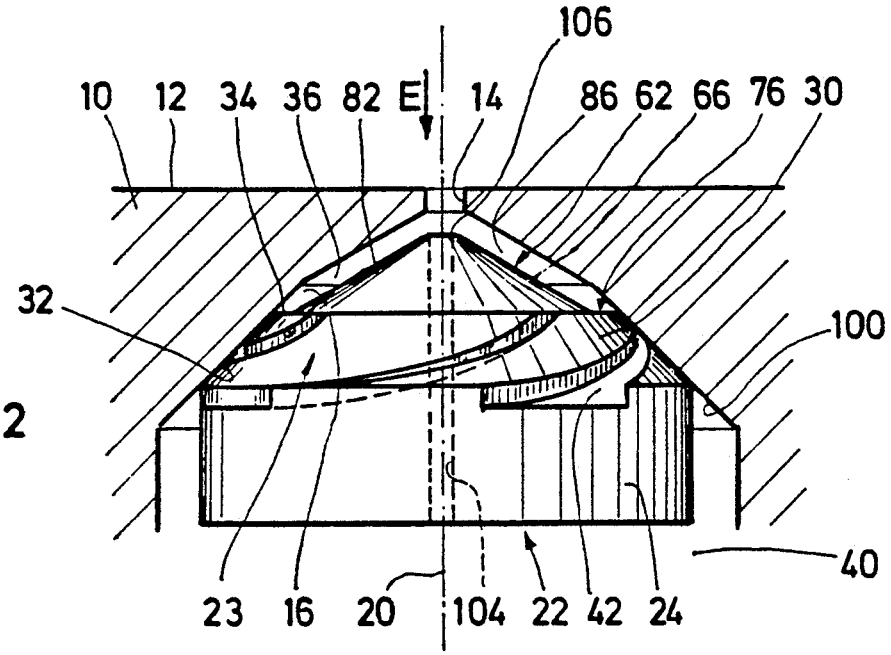
Figure 13:
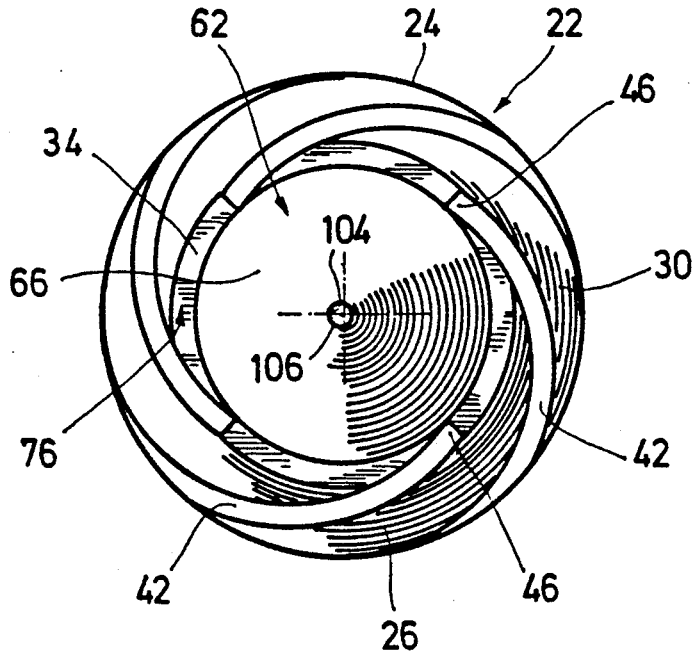
Figure 14:
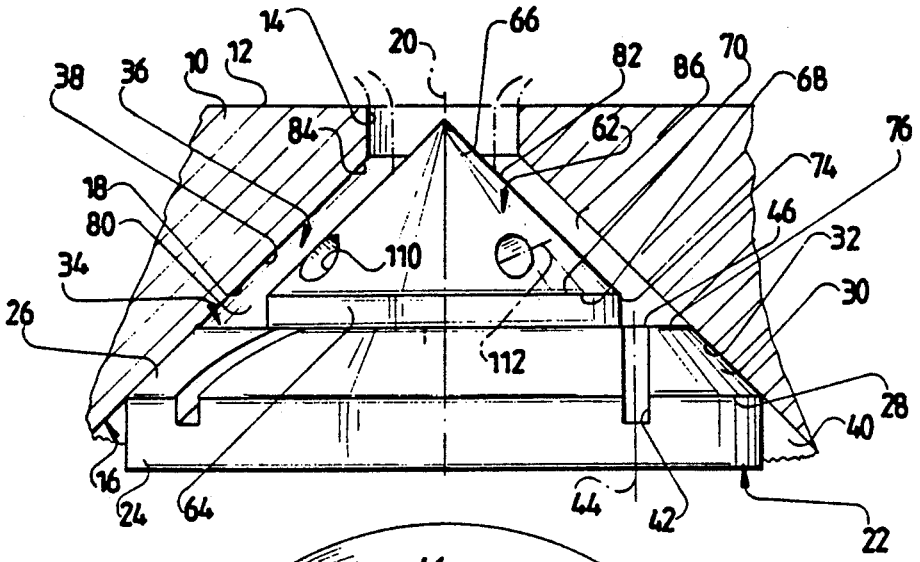
Figure 15:
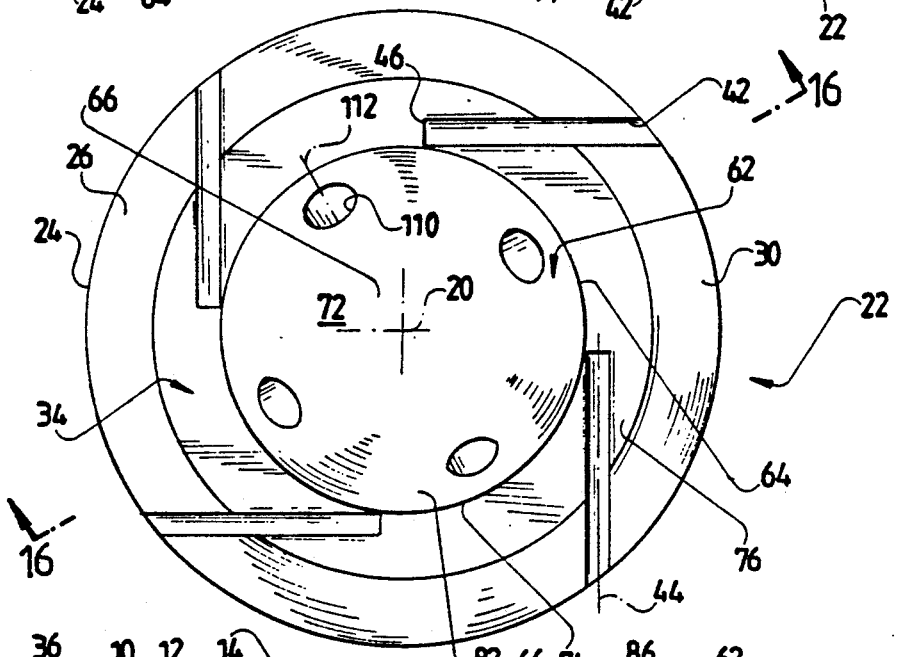
Figure 16:
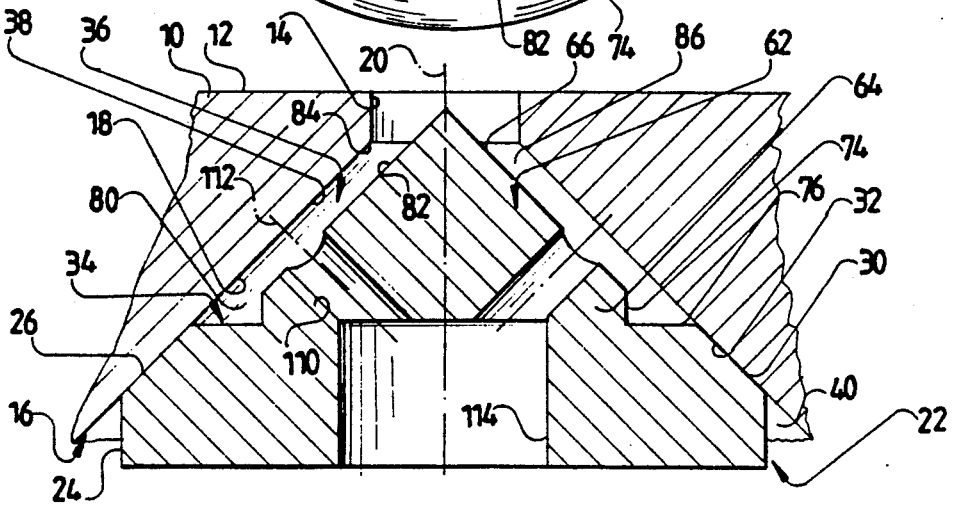
Figure 17:
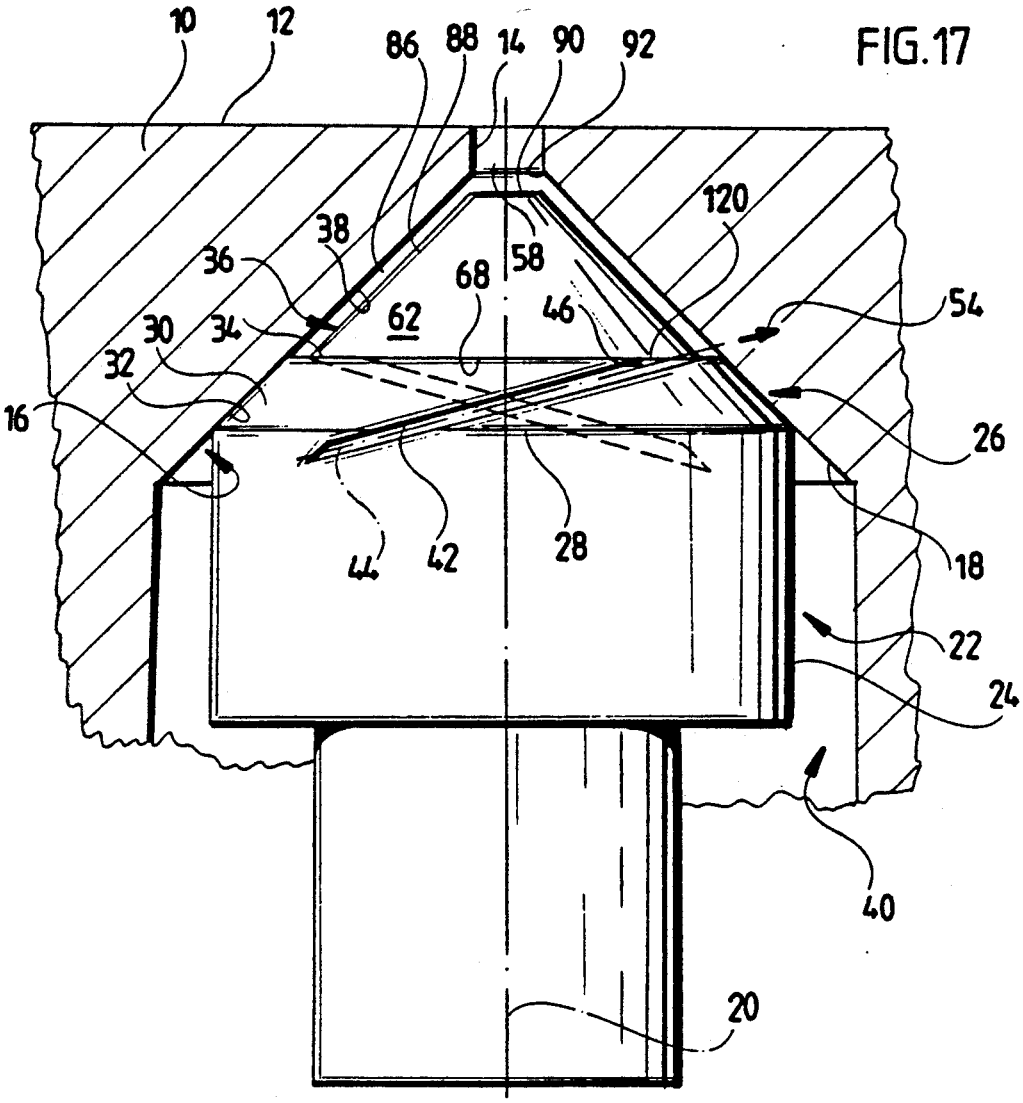
Figure 18:
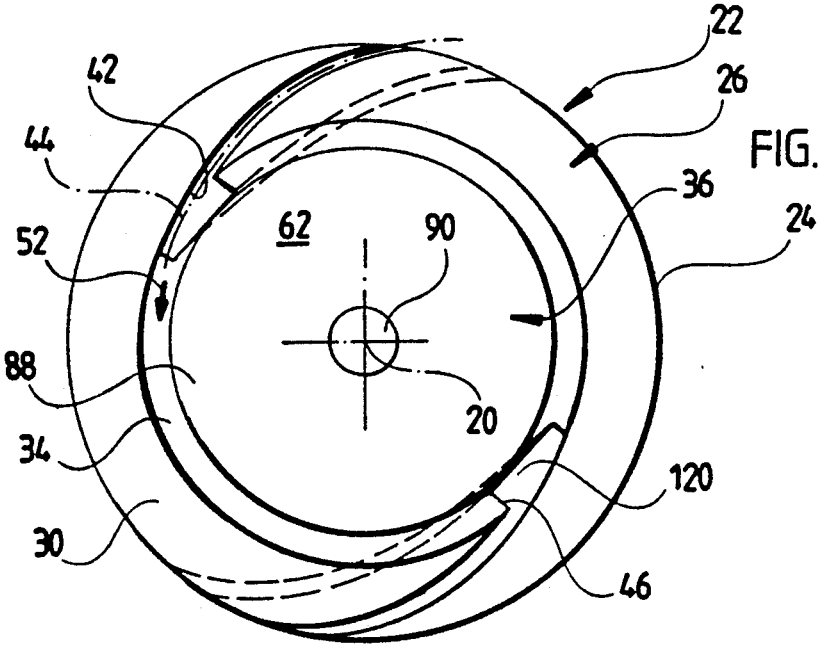

Further features and advantages are the subject of the following description and the drawings of several embodiments. The drawings show:

FIG. 1 a section through a known whirl nozzle,

FIG. 2 a view in the direction of arrow A in FIG. 1;

FIG. 3 a section through a first embodiment of the inventive whirl nozzle;

FIG. 4 a view in the direction of arrow B in FIG. 3;

FIG. 5 a perspective illustration of an inventive internal component;

FIG. 6 a section similar to FIG. 3 through a second embodiment;

FIG. 7 a perspective view similar to FIG. 5 of the second embodiment;

FIG. 8 a section similar to FIG. 3 through a third embodiment;

FIG. 9 a view in the direction of arrow C in FIG. 8;

FIG. 10 a section similar to FIG. 3 through a fourth embodiment;

FIG. 11 a view in the direction of arrow D in FIG. 10;

FIG. 12 a section similar to FIG. 3 through a fifth embodiment;

FIG. 13 a view in the direction of arrow E in FIG. 12;

FIG. 14 a view similar to FIG. 3 of a sixth embodiment;

FIG. 15 a plan view similar to FIG. 4 of the sixth embodiment;

FIG. 16 a section along line 16—16 in FIG. 15;

FIG. 17 a view similar to FIG. 3 of a seventh embodiment;

FIG. 18 a plan view similar to FIG. 4 of the seventh embodiment.

A whirl nozzle for atomizing a liquid, as known from the prior art, illustrated in FIGS. 1 and 2, comprises an external component 10, from the outer side 12 of which a nozzle outlet orifice 14 extends in the form of a cylindrical bore into the interior of the external component 10. Adjoining this nozzle outlet orifice 14 is a substantially conical recess 16, the wall surfaces 18 of which form the lateral areas of a conical frustum which is arranged coaxially with the nozzle outlet orifice 14 and is axially symmetrical with the central axis 20. Inserted into this recess 16 is an internal component 22 having a circular-cylindrical region 24 which is adjoined by a frustoconical region 26, the base area 28 of which is identical with the circular area. This frustoconical region 26 is so designed that lateral areas 30 are of the same segment of the lateral area of the cone on which also the wall surfaces 18 of the recess 16 lie. Hence the internal component 22 is held by a conical seating in a positively connected manner in the recess 16. The region of the wall surfaces 18 of the recess 16 against which the lateral areas 30 of the frustoconical region 26 of the internal component 22 rest is designated as conical seating surfaces 32 of the recess 16.

A surface of the frustoconical region 26 of the internal component 22 which is arranged opposite the base area 28 and aligned parallel to it extends perpendicularly to the central axis 20 and forms a whirl chamber bottom 34. A region of the recess 16 located above this whirl chamber bottom 34 is designated as whirl chamber 36. The wall surfaces 18 of the recess 16 which delimit the whirl chamber 36 are designated as whirl chamber walls 38. A space surrounded by the recess 16 and arranged on a side of the internal component 22 opposite the whirl chamber 36 is designated as pressure chamber 40. The liquid to be atomized is kept in it under pressure. Several whirl channels 42 lead from this pressure chamber 40 into the whirl chamber 36. As shown, in particular, in FIG. 2, these whirl channels 42 are preferably in the form of grooves in the lateral areas 30 leading into the pressure chamber 40 with a rectangular and approximately square cross-section in the circular-cylindrical region 24 of the internal element 22. They open into the whirl chamber 36 in the region of the whirl chamber bottom 34 and preferably in a radially outwardly located region with respect to the central axis 20. A central line 44 of each whirl channel 42, at least in the region of the port 46 thereof, is spaced at a distance e from the central axis 20 in the whirl chamber bottom 34, and there, therefore, emerges from the port 46 a liquid jet 48 which on leaving the port 46 lies in a plane 50 parallel to the central axis 20 and extending at the distance e from it. This liquid jet 48 has a speed component 52 parallel to the whirl chamber bottom 34 as well as a speed component 54 parallel to the central axis 20. The distance e is generally designated as eccentricity e of the whirl nozzle. Hence a liquid vortex 56 is created around the central axis 20 in the whirl chamber 36. At the center of the liquid vortex 56 there remains standing a cylinder-like air core 58 which is coaxial with the central axis 20 and around which the liquid vortex 56 flows so that there finally emerges from the nozzle outlet orifice 14 a liquid film cone 60 which disintegrates into small liquid droplets on account of its own instability.

A whirl parameter $S_o$ of such a nozzle is defined as follows:

$$S_0 = \frac{\text{rotary pulse flow}}{\text{axial pulse flow} \times \text{outlet radius}} = \frac{\pi \cdot \cos(\gamma)[\text{outlet radius } (\Gamma_a)] \cdot [\text{eccentricity } (e)]}{\text{total area of all whirl channels } (f_1 + f_2 + f_3 + f_4)}$$

$\gamma$ being the gradient of the whirl channels 42 in relation to the whirl chamber bottom 34, the outlet radius $\Gamma_a$ the radius of the nozzle outlet orifice 14 and $f_1$, $f_2$, $f_3$, $f_4$ the cross-sectional areas of the whirl channels 42. A definition of the whirl parameter is also to be found in the research report DFVLR-FB 87-25 (ISSN 0171-1342), page 22.

In a whirl nozzle, an air core always occurs when the whirl parameter $S_o$ is $>1$. Alternatively, the occurrence of an air core may also be made dependent on the ratio of the sum of all whirl channel areas $f_1$, $f_2$, $f_3$, $f_4$ to the cross-sectional area of the nozzle outlet orifice, which for this purpose should be less than 5.

Proceeding from this known design of a known whirl nozzle, a first embodiment of an inventive whirl nozzle, illustrated in FIGS. 3 to 5, exhibits the same parts and features which, therefore, bear the same reference numerals in FIGS. 3 and 5.

For a description thereof, reference is made to the above statements.

In contrast with the known whirl nozzle, in the first embodiment of the inventive whirl nozzle a displacement element 62 is placed on he whirl chamber bottom 34. The displacement element 62 comprises a cylindrical base 64 which is adjoined by a conical tip 66. The base area 68 of the conical tip 66 is identical with the end face 70 of the cylindrical base 64 facing it.

The entire displacement element 62 is axially symmetrical with the central axis 20. The cylindrical base 64 extends outwardly in the radical direction with respect to the central axis 20 as far as the ports 46 of the whirl channels 42. The displacement element 62, therefore, covers the whirl chamber bottom 34 in the central region 72 thereof and a cylindrical outer surface 74 of the cylindrical base 64 delimits in the inward direction a free annular region 76 of the whirl chamber bottom 34.

Hence the cylindrical outer surface 74 of the cylindrical base and a section of the whirl chamber wall 38 arranged opposite the cylindrical outer surface 74 near the whirl chamber bottom as well as the annular region 76 of the whirl bottom 34 form an annular space 80 into which the liquid jet 48 is injected tangentially to the outer surface 74 of the cylindrical base 64.

A surface 82 of the conical tip 66 extends in the form of the lateral area of a cone, as shown in FIG. 3, preferably at a distance b from a section 84 of the whirl chamber wall 38 near the outlet and parallel thereto. The width b preferably corresponds approximately to the width b of the whirl channels 42.

Hence the whirl chamber 36 in the first embodiment of the inventive whirl nozzle comprises an annular space 80 arranged near the whirl chamber bottom and adjoined by a space 86 which has the shape of the lateral area of a cone and is delimited by the conical surface 82 of the displacement element 62 and the section 84 of the whirl chamber wall near the outlet. The space 86 passes, in turn, into the cylindrical bore of the nozzle outlet orifice 14.

Hence the presence of an air core 58 in the whirl chamber 36 itself, which could negatively affect the liquid flow in the whirl chamber 36, was eliminated by the displacement element 62. It is only in the region of the nozzle outlet orifice 14 that an air core residue still forms, with the liquid film cone emerging around this from the nozzle outlet nozzle 14.

Insofar as a second embodiment of an inventive whirl nozzle, illustrated in FIGS. 6 and 7, is identical with the first embodiment of FIGS. 3 to 5, it has the same reference numerals. Reference is, therefore, made to the above statements for a description of the corresponding parts.

In contrast with the first embodiment, the displacement element 62 no longer has a conical tip but a conical frustum 88 seated on the cylindrical base 64 with a front face 90 arranged opposite the base area 68 of the latter and parallel to the whirl chamber bottom 34. The front face 90 lies in the whirl chamber 36 and has a diameter which is larger than the diameter of the nozzle outlet orifice 14. Hence in this embodiment the displacement element 62 does not extend over the entire height of the whirl chamber from the whirl chamber bottom 34 to a point of transition 92 of the whirl chamber walls 38 into the nozzle outlet orifice 14 but terminates at the base area 90 at a distance from this point of transition. Therefore, the same flow conditions exist above this front face 90 in the whirl chamber 36 as in the prior art above the whirl chamber bottom 34 and so an air core 58 which forms above the front face 90 extends to a slight degree, namely over a section corresponding to the distance of the base area 90 from the point of transition 92 between the whirl chamber wall 38 and the nozzle outlet orifice 14, in the whirl chamber 36. In spite of this, the inventive advantages are accomplished with this second embodiment because the region of the air core 58 along which the undesired characteristics thereof become effective is substantially shorter than if the inventive displacement element 62 were not present.

Insofar as the same parts are present in a third embodiment of the inventive whirl nozzle, illustrated in FIGS. 8 and 9, as in the embodiments described above, the same reference numerals are used, and reference is, therefore, made to the above description.

In contrast with the embodiments described above, the whirl channels 42 are no longer grooves with a straight center line 44. They do extend as a straight line along the lateral areas 30 of the internal component 22 but have a port 46 which is in the form of an annular segment 94 and hence provides the possibility of reducing the annular region 76 of the whirl chamber bottom 34 to the width b of the whirl channel 42 so that the distance e of the jet 48 emerging from the port 46 from the central axis 20 is almost identical with an outer radius of the whirl chamber bottom 34.

In this way, the displacement element 62 can be designed merely as a conical tip 66, with the base area 68 of the conical tip 66 extending with respect to the central axis 20 as far as an inside edge 96 of the ports 46 of the whirl channels 42 which are in the form of annular segments. Hence in this third embodiment the whirl chamber is reduced to the space 86 which has the shape of the lateral area of a cone and lies between the conical surface 82 of the displacement 62 and the whirl chamber wall 38.

Insofar as the same reference numerals are used, a fourth embodiment of an inventive whirl nozzle, illustrated in FIGS. 10 and 11, shows the same parts as the embodiments described above.

In contrast with the embodiments described so far, the fourth embodiment differs in that the wall surfaces of the recess 16 have two different sections 98 and 100. Section 98 which directly adjoins the nozzle outlet orifice 14 corresponds to the lateral area of a conical frustum, the apex angle of which is larger than that of the lateral area of the conical frustum of section 100 adjoining section 98, and the lateral area of the conical frustum of section 98 passes along a contact line 102 into the lateral area of the conical frustum of section 100.

Section 100 serves to form the conical seating surface 32 against which the internal component rests with its lateral areas 30. This internal component 22 is identical with the internal component 22 of the third embodiment with respect to the design of the whirl channels 42 and their ports 46. In addition, the displacement element 62 seated on the whirl chamber bottom 34 is designed exactly as in the third embodiment as a conical tip 66. The conical surface 82 does, however, extend parallel to section 98 at a distance b from it which corresponds approximately to the width of the whirl channels 42.

In order that the annular region 76 of the pressure chamber bottom 34 can be kept within the width of the whirl channel 42 and, furthermore, that the conical surface 82 of the displacement element 62 can extend at a distance b from section 98 corresponding to the width of the whirl channels 42, section 100 preferably extends beyond the conical seating surface 32 towards the nozzle outlet orifice 14 as far as the contact line 102. The whirl chamber 36 in the fourth embodiment, therefore, comprises an annular space which is formed by section 100 extending beyond the conical seating surface 32 as far as the contact line 102, the annular region 76 and part of the surface 82 of the displacement element 62 as well as the space 86 which has the shape of the lateral area of a cone and is delimited by section 98 and the remaining part of the surface 82 of the displacement element 62.

A fifth embodiment of the inventive whirl nozzle, illustrated in FIGS. 12 and 13, is substantially identical with the fourth embodiment. Therefore, the same parts also bear the same reference numerals. Differently from the fourth embodiment, however, the whirl channels 42 extend from the pressure chamber 40 to the whirl chamber 36 in the region of the lateral area 30 of the internal component 22 in helical configuration with respect to the central axis 20 and so these whirl channels 42 have, in relation to the central axis 20, a lower gradient than the whirl channels 42 of the fourth embodiment. Consequently, with the same overall flow velocity as in the whirl channel 42 of the previous embodiment, the jet 48 emerging from the port 46 has a smaller component 54 perpendicular to the whirl chamber bottom 34 and a larger velocity component parallel to the whirl chamber bottom 34. Therefore, in total, a larger tangential flow component with respect to the central axis 20 is achievable in the whirl channel 36.

In a particularly advantageous variant of the fifth embodiment, a reflux bore 104 is additionally provided. It is arranged concentrically with the central axis 20 and opens into the whirl chamber 36 opposite the nozzle outlet orifice 14 in the region of the displacement element 62. The displacement element 62 is no longer a cone but merely a conical frustum, the front face of which is formed by a port 106 of the reflux bore 104. Hence this reflux bore 104 extends through the entire displacement element 62 and also through the internal component 22 and is connected to a conventional return flow path which is described, for example, in German patent application P 37 03 075.2.

A sixth embodiment, illustrated in FIGS. 14 to 16, represents a variant of the first embodiment illustrated in FIGS. 3 to 5. Insofar as the same parts are used, these also bear the same reference numerals. For a description of these, reference is, therefore, made to the statements on the first embodiment.

In contrast with the first embodiment, this sixth embodiment comprises reflux bores 110 machined in the conical surface 82 of the conical tip 66. These reflux bores 110 extend with longitudinal axes 112, perpendicular to the conical surface 82, into the displacement element 62 towards its central axis 20 and open into a reflux channel 114 which is arranged coaxially with the central axis and leads from the conical tip 66 to the displacement element in the opposite direction into the interior of the nozzle.

In accordance with the invention, the reflux bores 110 are not arranged in the region of the nozzle outlet orifice 14 but in one over which section 84 of the whirl chamber wall 38 near the outlet extends and so the reflux bores 110 do not lie in the region of an air core forming in the nozzle outlet orifice 14.

Hence by selection of a certain eccentricity of the reflux bores 110, i.e., their distance from the central axis 20, the so-called return mass flow ratio can be advantageously controlled without, as in the known arrangements of a reflux bore, the diameter of the reflux bore having to be altered, which always causes problems with the dimensions and viscosity conditions that are expedient.

A fifth embodiment of the inventive whirl nozzle, illustrated in FIGS. 17 and 18, has similarities with the second embodiment and so the same parts also bear the same reference numerals.

Differently from the second embodiment, however, the whirl channels 42 extend from the pressure chamber 40 to the whirl chamber 36 in the region of the lateral area 30 of the internal component 32 in helical configuration with respect to the central axis 20 and so these whirl channels 42 have, in relation to the central axis 20, a lower gradient than the whirl channels 42 of the second embodiment. Consequently, with the same overall flow velocity as in the whirl channel 42 of the previous embodiment, the jet emerging from the port 46 has a smaller component 54 perpendicular to the whirl chamber bottom 34 and a larger velocity component parallel to the whirl chamber bottom 34. Therefore, in total, a larger tangential component with respect to the central axis 20 is achievable in the whirl channel 36.

The ports 46 are, furthermore, extended to an annular segment cutout 120, the width of which corresponds to the width of the annular whirl chamber bottom 34 between the frustoconical displacement element 62 and the whirl chamber walls 38.

In contrast with the second embodiment, the displacement element 62 rises without the cylindrical section as conical frustum 88 directly from the whirl chamber bottom 34 and extends as far as the front face 90, the diameter of which corresponds approximately to the radius of the nozzle outlet orifice 14.

In the seventh embodiment, it is particularly advantageous that the latter is easy to manufacture and that the cross-sectional area of the ports 46 is large, which results in relatively low viscosity-related pressure losses.

We claim:

1. A whirl nozzle for atomizing a liquid comprising:

a whirl chamber rising above a whirl chamber bottom and tapering towards a nozzle outlet orifice opposite said whirl chamber bottom;

an external component comprising said nozzle outlet orifice and an adjoining recess extending along a central axis and exhibiting a larger cross-section as it progresses further, said recess having wall surfaces forming the lateral area of a conical frustum which is coaxial with said central axis, a frustoconical internal component insertable into said recess in a positively connected manner and having said whirl chamber bottom extending perpendicularly to said central axis so that said whirl chamber bottom and said wall surfaces of said recess lying between aid whirl chamber bottom and said nozzle outlet orifice form a whirl chamber wall delimiting said whirl chamber, said wall surfaces of said recess forming a conical seating surface for said frustoconical internal component, said conical seating surface having a smaller apex angle than a section of said whirl chamber wall adjoining said nozzle outlet orifice, at least one whirl channel laterally offset in relation to said central axis of said whirl chamber and opening into said whirl chamber, a whirl parameter of $>1$, a displacement element rising above said whirl chamber bottom to prevent formation of an air core in a region of said whirl chamber near said bottom, said displacement element being arranged concentrically with said central axis, said displacement element comprising a section near said bottom having an external diameter corresponding to at least one diameter of said nozzle outlet orifice.

2. Whirl nozzle according to claim 1, characterized in that said displacement element extends with a mean diameter which corresponds to at least the diameter of said nozzle outlet orifice over at least approximately half of the height of said whirl chamber in the direction towards said nozzle outlet orifice.

3. Whirl nozzle according to claim 2, characterized in that said displacement element extends with a mean diameter which corresponds to at least the diameter of said nozzle outlet orifice over at least approximately two thirds of the height of said whirl chamber in the direction towards said nozzle outlet orifice.

4. Whirl nozzle according to claim 1, characterized in that a surface of said displacement element facing an outer whirl chamber wall is spaced in each cross-sectional plane with respect to said central axis all the way around in the circumferential direction at a constant distance from said whirl chamber wall.

5. Whirl nozzle according to claim 4, characterized in that in a section of said displacement element facing said nozzle outlet orifice, the surface facing said whirl nozzle chamber wall extends at a constant distance from said whirl chamber wall.

6. Whirl nozzle according to claim 5, characterized in that said distance corresponds approximately to a width (b) of said whirl channel.

7. Whirl nozzle according to claim 1, characterized in that said whirl chamber is axially symmetrical with said central axis.

8. Whirl nozzle according to claim 1, characterized in that a port of said whirl channel lies in an annular region of said whirl chamber bottom extending around said displacement element.

9. Whirl nozzle according to claim 8, characterized in that the width of said annular region corresponds to the extent of said port from an outer rim of this region in the radial inward direction.

10. Whirl nozzle according to claim 9, characterized in that said whirl channel leads with a port in the form of an annular segment along an outer rim region of said whirl chamber bottom into said whirl chamber.

11. Whirl nozzle according to claim 1, characterized in that said whirl channel extends in helical configuration with respect to said central axis from a pressure chamber to said whirl chamber.

12. Whirl nozzle according to claim 1, characterized in that said displacement element is provided with a central reflux bore.

13. A whirl nozzle for atomizing a liquid comprising:

a whirl chamber rising above a whirl chamber bottom and tapering towards a nozzle outlet orifice opposite said whirl chamber bottom, at least one whirl channel laterally offset in relation to a central axis of said whirl chamber and opening into said whirl chamber, a whirl parameter of $>1$, a displacement element rising above said whirl chamber bottom to prevent formation of an air core in a region of said whirl chamber near said bottom, said displacement element being arranged concentrically with said central axis, said displacement element comprising a section near said bottom having an external diameter corresponding to at least one diameter of said nozzle outlet orifice, said displacement element being provided with at least one reflux bore opening into said whirl chamber with a mouth arranged eccentrically with respect to said central axis.

14. Whirl nozzle according to claim 13, characterized in that said reflux bore is arranged at a distance form said central axis which corresponds to at least one radius of said nozzle outlet orifice.

15. A whirl nozzle for atomizing a liquid comprising:

a whirl chamber rising above a whirl chamber bottom and tapering towards a nozzle outlet orifice opposite said whirl chamber bottom, at least one whirl channel laterally offset in relation to a central axis of said whirl chamber and opening into said whirl chamber, a whirl parameter of $>1$, a displacement element rising above said whirl chamber bottom to prevent formation of an air core in a region of said whirl chamber near said bottom, said displacement element being arranged concentrically with said central axis, said displacement element comprising a section near said bottom having an external diameter corresponding to at least one diameter of said nozzle outlet orifice, said displacement element being provided with at least one eccentrically arranged reflux bore, said reflux bore being arranged at a distance from said central axis which is smaller than the distance of a port of said whirl channel therefrom

* * * * *